US005963232A

United States Patent [19]

Kasamoto et al.

[11] Patent Number: 5,963,232

[45] Date of Patent: Oct. 5, 1999

[54] INK JET RECORDING HEAD AND METHOD OF FORMING AN INK JET RECORDING HEAD

[75] Inventors: Masami Kasamoto, Ayase; Masashi Kitani, Yokohama; Shuji Koyama, Kawasaki; Masahiko Higuma, Tohgane; Yoichi Taneya, Yokohama, all of Japan

[73] Assignee: Canon Kabushiki Kaisha, Tokyo, Japan

[21] Appl. No.: 08/937,784

[22] Filed: Sep. 24, 1997

Related U.S. Application Data

[63] Continuation of application No. 08/364,940, Dec. 28, 1994, abandoned.

[30] Foreign Application Priority Data

Dec. 28, 1993 [JP] Japan ..... 5-334419
May 31, 1994 [JP] Japan ..... 6-118547

[51] Int. Cl.[6] ..... B41J 2/05

[52] U.S. Cl. ..... 347/58; 347/59

[58] Field of Search ..... 347/50, 56, 57, 347/58, 59, 63

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,686,544 | 8/1987 | Ikeda et al. | 347/64 |
| 4,723,129 | 2/1988 | Endo et al. | 347/56 |
| 4,740,796 | 4/1988 | Endo et al. | 347/56 |
| 4,881,318 | 11/1989 | Komuro et al. | 29/827 |
| 5,081,474 | 1/1992 | Shibata et al. | 347/59 |
| 5,159,353 | 10/1992 | Fasen et al. | 347/50 |

FOREIGN PATENT DOCUMENTS

| | | |
|---|---|---|
| 0452663 | 10/1991 | European Pat. Off. . |
| 0538842 | 4/1993 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |
| WO90/06851 | 6/1990 | WIPO . |

*Primary Examiner*—N. Le
*Assistant Examiner*—L. Anderson
*Attorney, Agent, or Firm*—Fitzpatrick, Cella, Harper & Scinto

[57] ABSTRACT

An ink jet recording head includes a substrate with ejection energy generating elements for ejecting ink, a wiring board electrically connected at a first connecting region to an electric connection pad on the substrate and functioning to apply voltage to the ejection energy generating elements, and a plate is combined with the substrate, the plate being provided with a groove constituting an ink passage when it is combined with the substrate. A second connecting region is found between the substrate and plate, the substrate having a projection at a position between the second connecting region and the pad, the first connecting region and second connecting region each being sealed by a resin sealing material.

42 Claims, 14 Drawing Sheets

SPREAD = A + B [mm]

| SEALANT | SE 9140 | JCR 6123 | JCR 6182 | TUV 6000 | TSE 397 | TSE 399 |
|---|---|---|---|---|---|---|
| SPREAD (mm) | 59 | 57 | 69 | 73.5 | 66 | 115 |
| 40 | G | G | G | G | G | NG |
| 70 | G | G | G | G | G | NG |
| 100 | G | G | G | G | G | NG |
| 10 20 10 | G | G | G | G | G | G |
| 20 30 20 | G | G | G | G | G | G |
| 30 40 30 | G | G | G | G | G | G |

OVERFLOW PREVENTION
G: GOOD
NG: NO GOOD

PROJECTION HIGHT 40μm

FIG. 6

| | ONE PRJ. (NO GROOVE) | | | TWO PRJS. (NO GROOVE) | | | ONE PRJ. (WITH GROOVE) | | |
|---|---|---|---|---|---|---|---|---|---|
| PROTECTION WIDTH (μm) | 40 | 70 | 100 | 10/20/10 | 20/30/20 | 30/40/30 | 10/20/10 | 20/30/20 | 30/40/30 |
| SHAPE | 40 | 70 | 100 | 10 20 10 | 20 30 20 | 30 40 30 | 10 20 10 | 20 30 20 | 30 40 30 |
| CONTACTNESS | G | G | G | NG | NG | NG | G | G | G |
| OVERFLOW PREVENTION | NG | NG | NG | G | G | G | G | G | G |

PROJECTION HEIGHT 40μm

FIG. 10A

| | ONE PRJ. TWO GROOVE | | ONE PRJ. (THREE GROOVE) | |
|---|---|---|---|---|
| PROTECTION WIDTH (μm) | 10/20/10/20/10 | 20/20/20/20/20 | 10/10/10/10/10/10/10 | 20/10/20/10/20/10/20 |
| SHAPE | 20 20 10 10 10 | 20 20 20 20 20 | 10 10 10 10 10 10 10 | 20 20 20 20 10 10 10 |
| CONTACTNESS | G | G | G | G |
| OVERFLOW PREVENTION | G | G | G | G |

CONACTNESS
G:NO PEELING
NG:PEELED

OVERFLOW PREVENTION
G:NO OVERFLOW
NG:OVERFLOW

PROJECTION HEIGHT 40μm

FIG. 10B

| | A: ONE PRJ. | | | B: TWO PRJS. | | | C: TWO PRJ. (WITH BTM GROOVES) | | |
|---|---|---|---|---|---|---|---|---|---|
| PROTECTION WIDTH (μm) | 40 | 70 | 100 | 10/10/10 | 20/20/20 | 30/30/30 | 10/10/10 | 20/30/20 | 30/30/30 |
| SHAPE | | | | | | | | | |
| CONTACTNESS | G | G | G | NG | NG | NG | G | G | G |
| OVERFLOW PREVENTION | NG | NG | NG | G | G | G | G | G | G |
| GROOVER | NO | | | NO | | | YES WITH 10μm SPACE | | |

CONACTNESS
G: NO PEELING
NG: PEELED

OVERFLOW PREVENTION
G: NO OVERFLOW
NG: OVERFLOW

INK JET RECORDING HEAD AND METHOD OF FORMING AN INK JET RECORDING HEAD

This application is a continuation of application Ser. No. 08/364,940 filed Dec. 28, 1994, now abandoned.

FIELD OF THE INVENTION AND RELATED ART

The present invention relates to an ink jet recording head, an ink jet recording apparatus usable with the same, and an ink jet recording head manufacturing method, in which recording liquid (ink or the like) is ejected through an ejection outlet (orifice) onto a recording material.

An ink jet recording type in which a droplet of the ink produced and is deposited on the recording material such as sheet of paper, is advantageous in that the noise is low and high speed recording is possible on a plain paper. Among them, an ink jet recording system using energy generating element to eject the ink is widely used and particularly noted from the standpoint of the easiness of the high density arrangement of the energy generating elements.

Referring first to FIGS. 13–15, there is shown a typical structure of an ink jet recording head of such a type.

FIG. 13 shows ejection element of an ink jet recording head. On a silicone substrate 101, there are provided heat generating elements for producing election energy, wiring 102 for supplying electric signals to the heat generating elements. They are formed film forming process used in a semiconductor manufacturing field. The heat generating element 103 is, disposed in an ink passage, and in response to a driving signal supplied from a main apparatus, the ink in the ink passage is heated to produce state change of the ink to create a bubble. By the volume change of liquid due to the bubble creation, the ink is ejected through the ejection outlet.

Designated by 105 is a top plate with groove having integral groove walls, common ink chamber wall 104 and ejection outlet plate. The plate 105 and the silicone substrate 101 are connected to constitute the ink passages and the common ink chamber. The ink is supplied to the ejection element through a common ink inlet 107 formed in the top plate 105. A filter 106 is provided at the common ink inlet 107.

In the case that the ink passage are formed by connecting the top plate And the base plate, the use of bonding material between the top plate and the base plate is not preferable because of the liability of the bonding material entering the ink passage with the result of the change of the passage configuration. In consideration of this, at least the passage wall portion are connected only by mechanical pressing. However, the mechanical pressing may not be sufficient to assure the connection therebetween at all of the ink passages, and therefore, a sealing member is often used in order to increase the sealing property of the recording head. The sealing material is used at the connecting portion of the ink jet recording head at positions contactable to the ink. A sealing material is used at the wire bonding portion between the substrate and the wiring substrate for the purpose of corrosion prevention and disconnection prevention.

FIG. 14 shows an ink jet recording head of the above-described type, and FIG. 15 shows the structure around the ejection outlet of such an ink jet recording head. The ejection element 201 and the flexible wiring board (PCB) 202 for transmitting the driving signal from the ink jet recording head to the ejection element 201, are bonded and fixed on a base plate 203 for supporting the ejection element. They are electrically connected by wire bonding 201. To this, an ink receiving member 205, and a front cover 204 having an opening 207 is connected. In order to seal the connection portion of the members contactable to the ink and the wire bonding portion, silicone resin 301 (sealing material) is filled as shown in FIG. 15.

As a method of manufacturing such an ink jet recording head, there is a following method. On a silicone substrate, heat generating elements, and wiring for the heat generating elements are formed through a film forming process including sputtering or the like into a heater board. Subsequently, the heater board and the PCB board are bonded on the base plate, and they are electrically connected by wire bonding using aluminum leads. Thereafter, the top plate with the grooves formed injection molding or the like from polysulfone resin material or the like is connected on the heater board. Finally, the base plate is provided with a front cover, and the sealing material such as silicone resin or the like is applied to the connecting portions and the wire bonding portions. Thus, the recording head is manufactured. In such an ink jet recording head, the wire bonding portion is exposed to the ambience before the sealing material is applied, and therefore, it is not durable against external impact. For example, when the base plate is handled atter all the wirings are completed, the electric disconnection may occur in the wire bonding portion, with the result of yield decrease. In addition, the wire bonding portion may be oxidated or contaminated by atmosphere or chemicals. In order to prevent these, it would be considered to seal the wire bonding portion before the top plate is connected. However, when the distance between the end of the heater board and the wire bonding pad is short, for example, the distance is shorter than 1 mm, the sealing member overflows to the portion of the heater board where the top plate is to be connected, and therefore, there is a possibility that a gap occurs between the top plate and the base plate. If there occurs the gap between the top plate and the base plate, the ink jet recording head may be such that the cross-talk occurs with the result of improper ink ejection. In the recent ink jet recording head, the distance between the wire bonding pad and the end of the heater board tends to reduce from the demand for the downsizing. Therefore, the possibility of the overflow of the sealing material increases. By the reduction of the size of the recording head, the top plate may extend over the wire bonding portion to increase the volume of the liquid chamber. In this case, the sealing of the wiring portion after the connection of the top plate is difficult.

SUMMARY OF THE INVENTION

Accordingly, it is a principal object of the present invention to provide an ink jet recording head, an ink jet recording apparatus and an ink jet recording head manufacturing method wherein the sealing material does not overflow to the portion of the heater board where the top plate is to be connected.

It is another object of the present invention to provide an ink jet recording head, an ink jet recording apparatus and an ink jet recording head manufacturing method in which the overflow is prevented even if the wire bonding portion is sealed before the connection of the top plate.

It is a further object of the present invention to provide an ink jet recording head, an ink jet recording apparatus and an ink jet recording head manufacturing method In which the wire bonding portion can be sealed beforehand.

It is a further object of the present invention to provide an ink jet recording head, an ink jet recording apparatus and an ink jet recording head manufacturing method in which oxidation contamination and disconnection of the wire bonding portion is prevented, thus improving the yield and reliability.

According to an aspect of the present invention, there is provided an ink jet recording head comprising a substrate having a plurality of ejection energy generating element for ejecting ink; a wiring board electrically connected to an electric connection pad on said substrate and functioning to apply a voltage to said ejection energy generating element; a plate combined with said substrate, said plate being provided with a groove constituting an ink passage when it is combined with said substrate; wherein a first connecting portion for electric connection between said substrate and said wiring board and a second connecting portion between said substantial and said plate, are sealed by a sealing material; wherein said substrate is provided with a projection at a position between said second connecting portion and the pad.

According to another aspect of the present invention, there is provided an ink jet recording head comprising a substrate having a plurality of ejection energy generating element for ejecting ink; a wiring board electrically connected to an electric connection pad on said substrate and functioning to apply a voltage to said ejection energy generating element; a plate combined with said substrate, said plate being provided with a groove constituting an ink passage when it is combined with said substrate; wherein a first connecting portion for electric connection between said substrate and said wiring board is sealed by a first sealing material, and a second connecting portion between said substantial and said plate is sealed by a second sealing material; wherein said substrate is provided with a projection at a position between said second connecting portion and the pad to provided a boundary between the first sealing material and the second sealing material.

According to a further aspect of the present invention, there is provided an ink jet recording head manufacturing method, wherein the ink jet recording head includes a substrate having a plurality of ejection energy generating element for ejecting ink; a wiring board electrically, connected to an electric connection pad on said substrate and functioning to apply a voltage to said ejection energy generating element; a plate combined with said substrate, said plate being provided with a groove constituting an ink passage when it is combined with said substrate; wherein a first connecting portion for electric connection between said substrate and said wiring board is sealed by a first sealing material, and a second connecting portion between said substantial and said plate is sealed by a second sealing material; wherein said substrate is provided with a projection at a position between said second connecting portion and the pad; and wherein before connection of the plate, the electric connection between said substrate and said wiring board and sealing of said first connecting portion are carried out.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 6 illustrates a projection forming method according to a first embodiment of the present invention.

FIGS. 10A and 10B illustrate contactness relatively to the width of the projection and the configuration thereof and the extension of the sealing member beyond the projection in an ink jet recording head according to a second embodiment of the present invention.

DESCRIPTION OF THE PREFERRED EMBODIMENTS

Embodiment 1

Figure 1A:
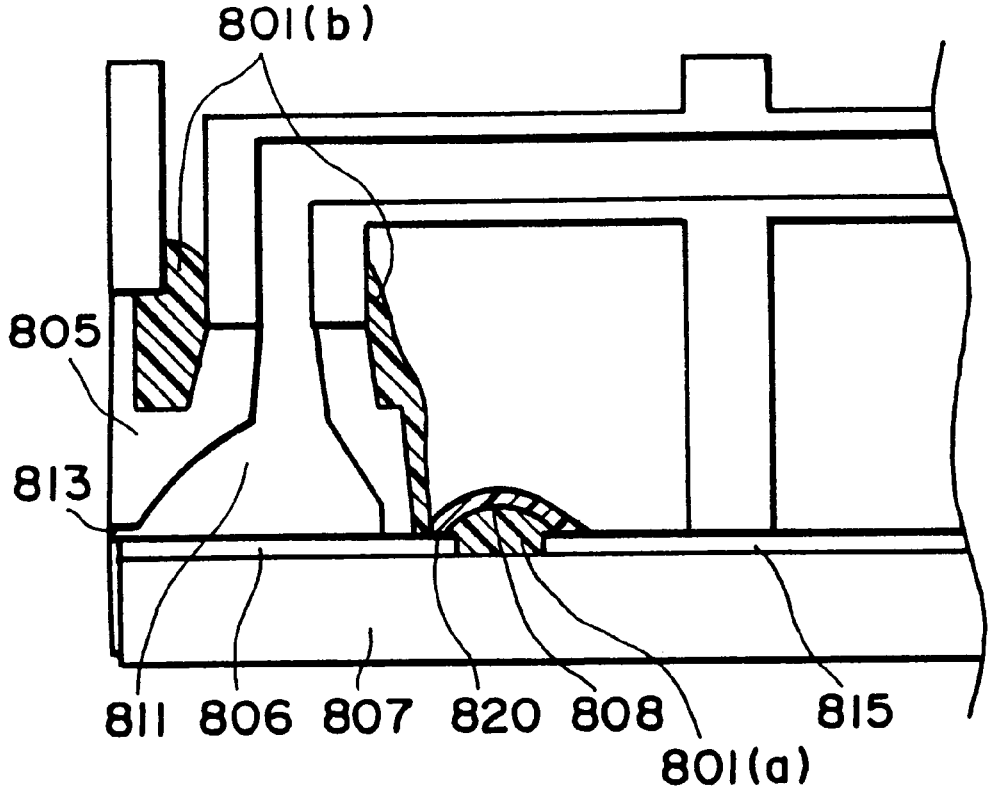
FIGS. 1A and 1B are a schematic view of an ink jet recording head according to a first embodiment of the present invention.
Figure 1B:
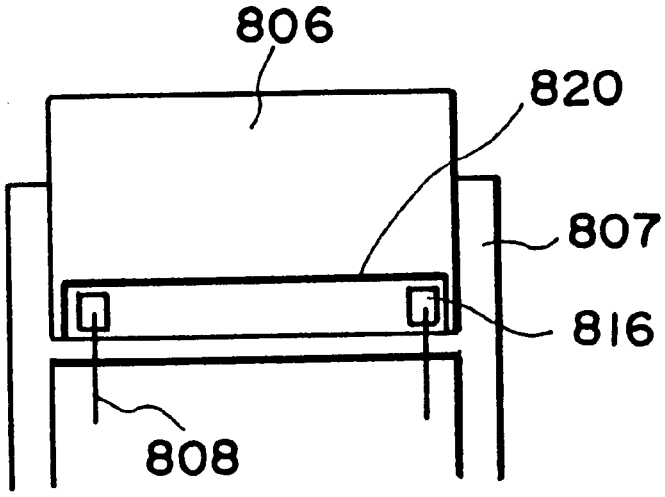

FIG. 1A is a sectional view of an ink jet recording head according to a first embodiment of the present invention, and FIG. 1B is a top plan view thereof. In FIG. 1, reference numerals 807, 806, 805 and 815 designate a base plate, heater board, a top plate with grooves and wiring board (PCV), respectively. By connecting the heater board 806 and the top plate 805 with each other, a liquid chamber 811 and liquid passages 813 are constituted. At the rear end of the heater board 806, there is provided electrode pads 816 for electric connection with the wiring board 815. The electrode pads of the heater board 806 and the wiring board 815 are connected by wire bonding 808. Designated by a reference numeral 820 is a projection formed between the wire bonding pad 816 and a portion of the heater board where the top plate is to be connected. The projection 820 is formed of photosensitive resin material capable of being developed with alkali developer. By forming the projection 820 by photosensitive resin, it can be easily formed with high precision through photolithography, and in addition, it can be formed at a predetermined position of the heater board beforehand, and therefore, can be formed without increasing significantly the manufacturing steps. The photosensitive resin material may be liquid or solid. From the standpoint of capability of increasing the height of the projection 820, a dry film is preferably used. In order to stop the sealing material by the projection 820, the higher projection 820 is preferable. Using the dry film through the photolithography patterning, the projection 820 can have a height of 10–80 μm. As for the dry film usable in this invention, there are α-540 (available from Tokyo Onka Kogyo Kabushiki Kaisha, Japan), PHOTEC (available from Hitachi Kasai Kabushiki Kaisha, Japan), VACREL (available from Du Pont).

Designated by 801(*a*) is a first sealing member for sealing the wire bonding portion, and the projection 820 on the heater board 806 is effective to prevent the first sealing material from overflowing to the top plate. Designated by a reference 801(*b*) is a second sealing member for sealing the connecting portion of the members for constituting ink passages, represented by the top plate connecting portion.

As for the sealing material usable in an ink jet recording head, there are silicone material, silicone modified material, urethane material, epoxy material or the like. The first scaling member and the second sealing member may be the same or similar or different. However, since it is difficult for the sealing member satisfy all the requirements by the ink jet recording head, it is desirable to use different sealing materials in combination. More particularly, the sealing material for the ink jet recording head desirably satisfy the following:

(1) The bonding strength is sufficient to avoid disconnection in use;

(2) The stress braking nozzle elements supplying system parts is not produced even if the temperature change occurs;

(3) It exhibit anti-ink property and does not influence the performance of the ink, although the degree of the natures are different depending on the positions where it is used;

(4) Air-sealing property is enough to prevent introduction of the air in the ink supply system; and (5) It does not contain corrosive material when it scals simultaneously electric connections.

In this embodiment, the first sealing member is selected so as to exhibit the proper stress requirement, anti-corrosion property, and the second sealing material is selected so as to exhibit the anti-ink property and air sealing property. Thus, the functions of the sealing member is separated to provide the total satisfactory performance. In this embodiment, the first sealing member is a silicone sealing member and the second sealing member is a silicone modified urethane sealing material.

The second sealing material may seal the connecting portion of the ink passage constituting member and also covers the first sealing member.

Figure 2:
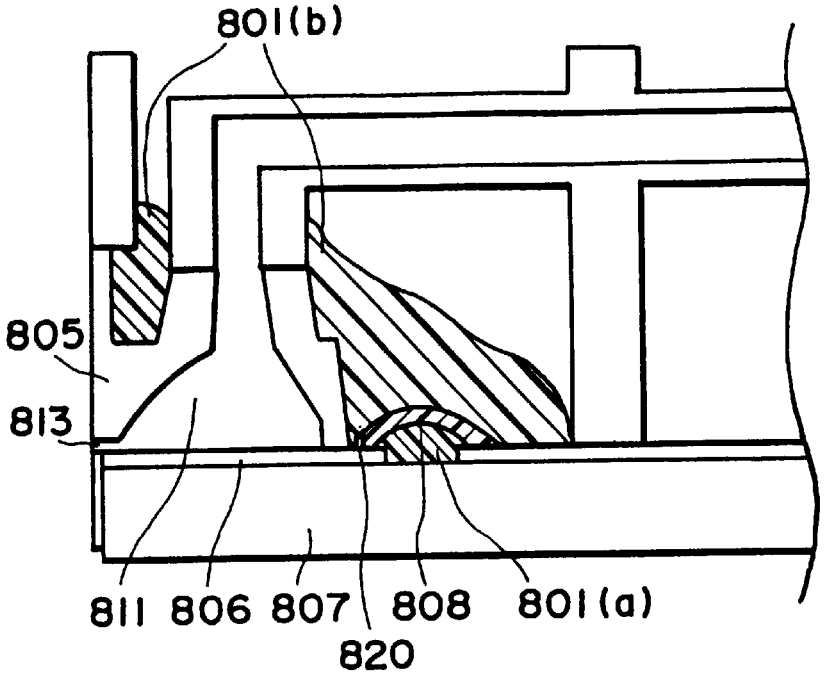
FIG. 2 is a schematic view of an ink jet recording head using another example of a sealing material application zone.
Figure 3:
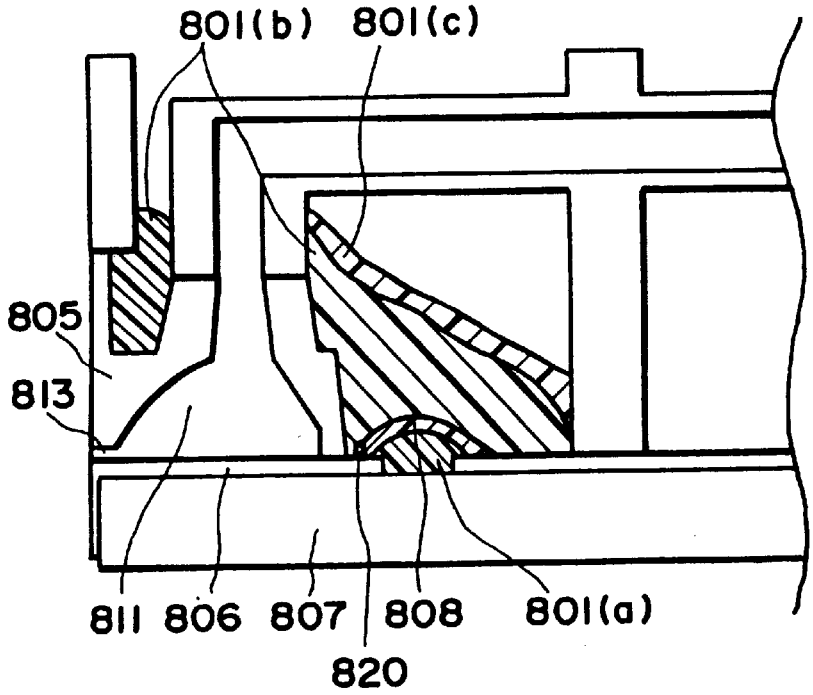
FIG. 3 is a schematic view of an ink jet recording head using another example of the sealing material application zone.

In addition, as shown in FIG. 3, by constituting the first sealing member 801(*a*) and the second sealing member 801(*b*) by the silicone sealing member, and a silicone modified urethane sealing material 801(*c*) may cover them. The similar sealing property as in FIG. 2 can be provided in this case.

As for the method of forming the projection, in place of the photolithography, UV-curing bonding material may be applied by a dispenser, or a screen printing is usable.

The description will be made as to an ink jet recording head manufacturing method according to an embodiment of this invention.

Using the photolithography technique or film forming technique on a silicone wafer becoming a heater board, heat generating elements (energy generating elements), wiring for the heat generating elements, wire bonding pads for electric connections, are formed. At this time, a function layer such as a protection layer or the like may be provided, as desired.

Figure 4:
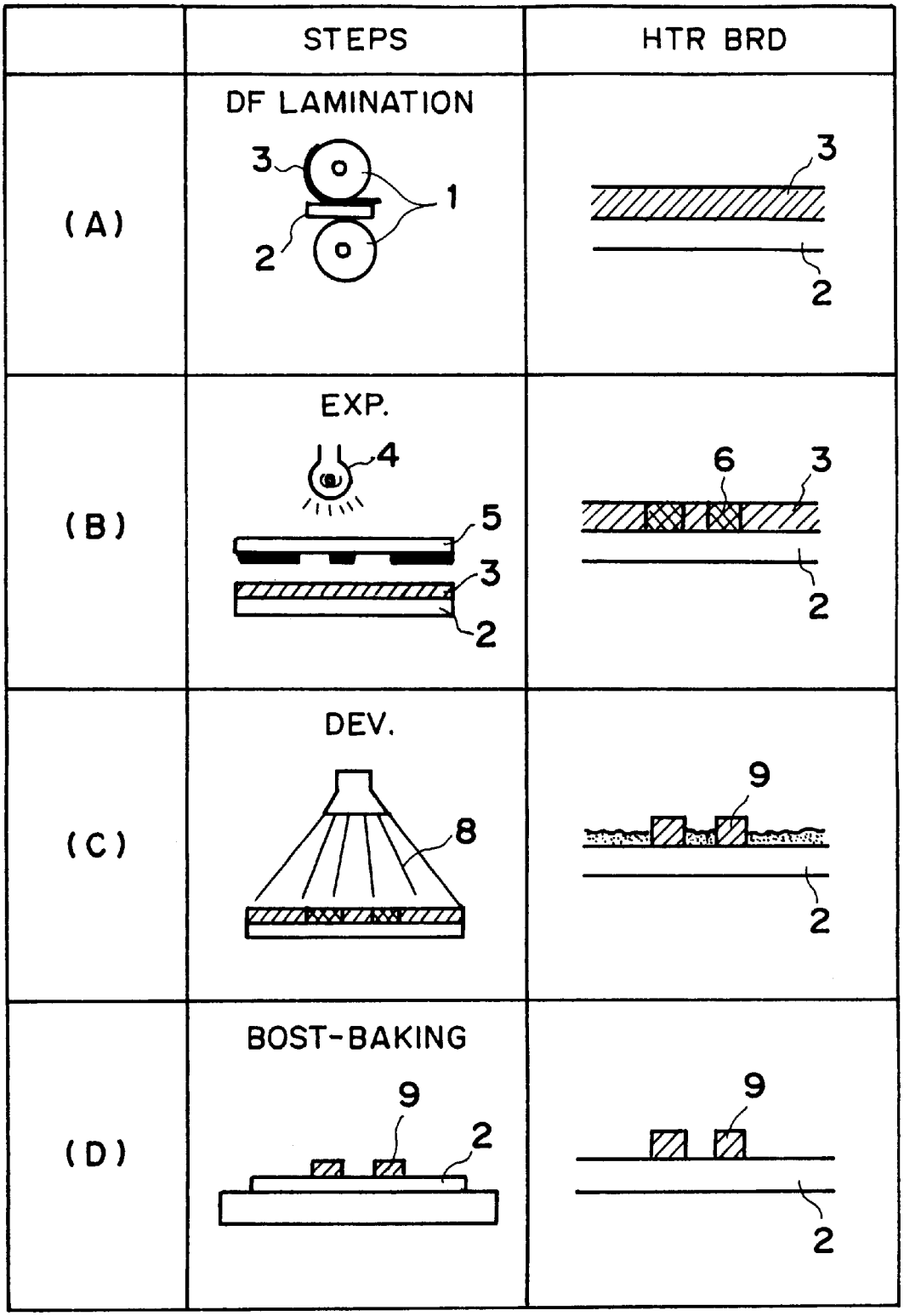
FIG. 4 illustrates extension of the sealing member and the overflow or extension of the sealing member beyond a projection.

The silicone wafer 2 is laminated with 40 μm of negative type dry film (DF) 3 (α-540 by a laminator HRL-24 (available from Listen)), as shown in FIG. 4A. As shown in FIG. 4B, a photomask is used, and the exposure is carried out using parallel beam with exposure apparatus 4, PLA 600 (available from Canon Kabushiki Kaisha, Japan). As shown in FIG. 4C, shower development is effected using alkali solvent 8 containing 0.5% of TMAH (tetramethyl ammonium hydroxide, as shown in FIG. 4C). Then, post-baking is effected using hot plate for one minute at 120° C. and one minute as 180° C. By this, a projection 9 for preventing overflow of the sealing material is formed, as shown in FIG. 4D. Subsequently, the silicone wafer 2 is cut into individual heater boards. They are cleaned by high pressure cleaning with pure water at 70 kgf/cm$^2$ with the distance of 10 mm between the wafer and the cleaning nozzle.

The heater board PCB thus manufactured is bonded on the base plate, and the wire bonding pad on the wiring board are electrically connected through wire bonding.

Thereafter, as the first sealing material, TSE 6020 (available from Toshiba Silicone Kabushiki Kaisha, Japan) or SE9140 (Toray Dew Corning Silicone Kabushiki Kaisha, Japan) is injected by a dispenser thus sealing the wire bonding portion. At this time, the first sealing member is stopped by the projection formed on the heater board, and therefore, is prevented from overflowing to the portion where the top plate is to be connected.

Subsequently, the top plate is connected on the heater board, and to the top plate, an ink supply unit for supplying the ink to the ink jet head is connected.

Finally, a silicone modified urethane sealing material, Takenate S-1100 (available from Takeda Yakuhin Kogyo Kabushiki Kaisha, Japan) as the second sealing material is dispensed by a dispenser to the ink supply portion connecting portion, represented by the connecting portion of the top plate. Thus, the ink jet recording head is manufactured.

In the ink jet recording head of this embodiment, the first sealing member does not flow into the portion where the top plate is to be connected or mounted. Therefore, the sealing property of the sealing material is improved.

When the first sealing material is injected using the dispenser, the first sealing member may overflow beyond the projection depending on the positional accuracy between the dispenser and the substrate, because the height of the projection is limited at approx. 80 μm.

Figure 5:
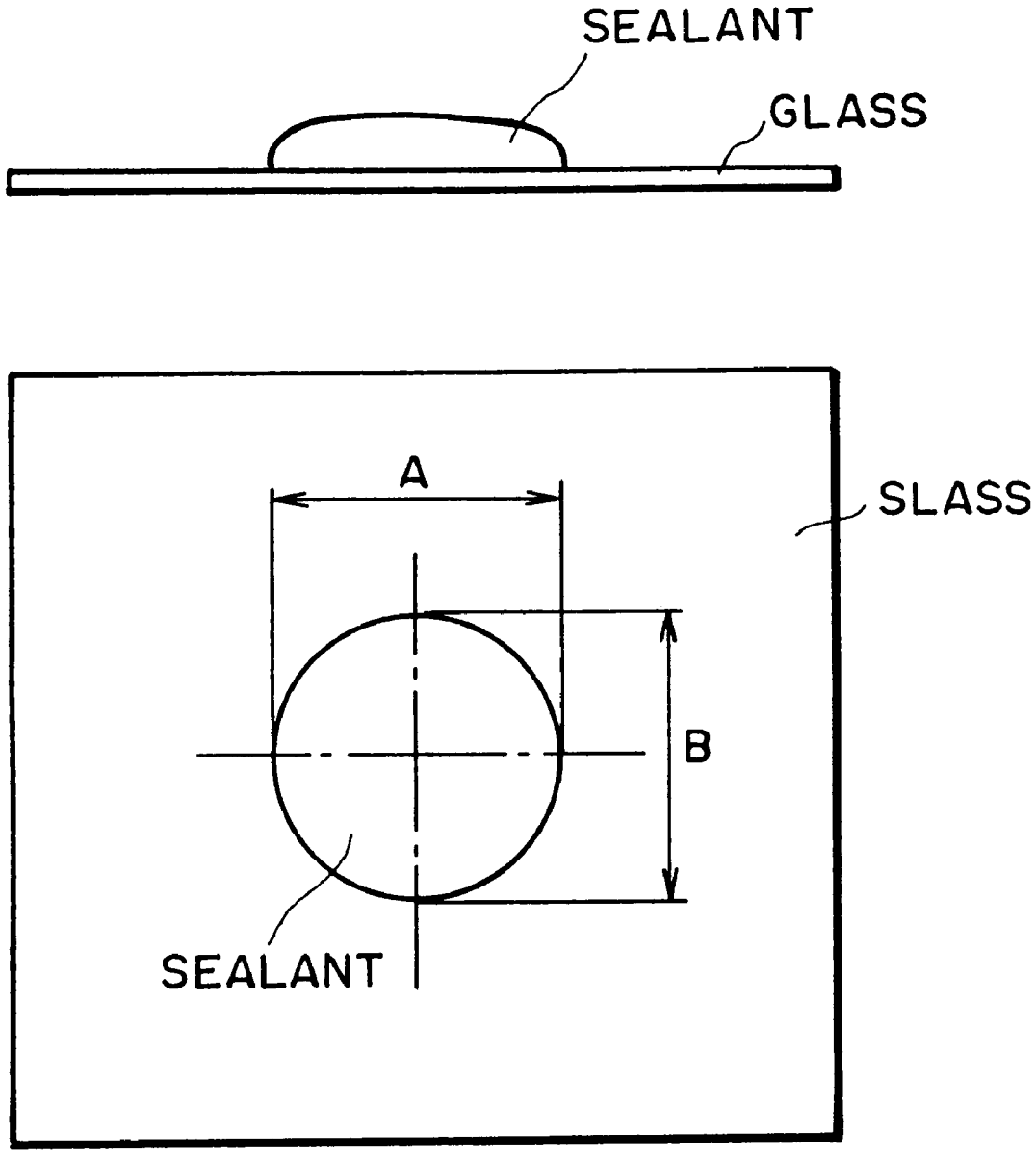
FIG. 5 illustrates a measuring method of the extension of the sealing material.

The investigations have been made as to the relation between the flowability of the sealing material and the extension beyond the projection, and as a result, the following has been found. In this embodiment, the flowability is measured through the following method that is, 2 g of the sealing material is applied on a glass base plate having been cleaned with isopropyl alcohol, and the expansion of the sealing material after 30 minutes is measured in each of orthogonal two directions, as shown in FIG. 5, and the sum thereof is represented as the flowability.

It has been found that the overflow of the sealing member beyond the projection can be almost prevented by using the material exhibiting the expansion of 74 mm or less.

The sealing materials shown in FIG. 6, are used as the first sealing member. The configuration of the projection is changed to that shown in FIG. 6. FIG. 6 shows the expansion degree of the sealing member used in the experiments and the extension of the sealing material beyond the projection.

As will be understood from FIG. 6, only one projection is used, the sealing material does not overflow the projection when the degree of extension or expansion of the material is 74 mm or less. When a plurality of projections are used, the sealing material does not overflow beyond the projection irrespective of the degree of the expansion of the sealing material.

In an ink jet recording head according to this embodiment, a certain recording head was such that the projection has been removed from the substrate prior to the sealing with the first sealing material. The investigations have been made, and the following has been found: the projection is removed during the high pressure cleaning step among the recording head manufacturing steps. This is considered as being because of the insufficient strength of the projection. From this standpoint, a relationship between a width of the projection and the removal thereof is investigated, and it has been found that the projection is removed if the width of the projection is 30 $\mu$m or less, when the film thickness is 40 $\mu$m. Therefore, it has been found that the removal can be avoided if the width of the projection is not less than 40 $\mu$m.

Embodiment 2

As described in the foregoing, when a plurality of projections are formed with the width of the projection larger than 40 $\mu$m, there is no liability of the overflow of the sealing material beyond the projection. However, in order to provide the plurality of projections having a width not less than 40 $\mu$m, the area occupied by the projections is extended. Therefore, the area can not be used in the case of small size substrate. In this case, the particular problem is the strength of the projection. According to the second embodiment, in order to assure the strength, a groove or grooves parallel with the projection (extending in a direction in which the energy generating elements are arranged) are formed on the top surface of the projection. By doing so, even if the number of projection is 1, the sealing member can be effectively prevented from overflowing beyond the projection, as in the case of using a plurality of projections, in an ink jet recording head.

Figure 7A:
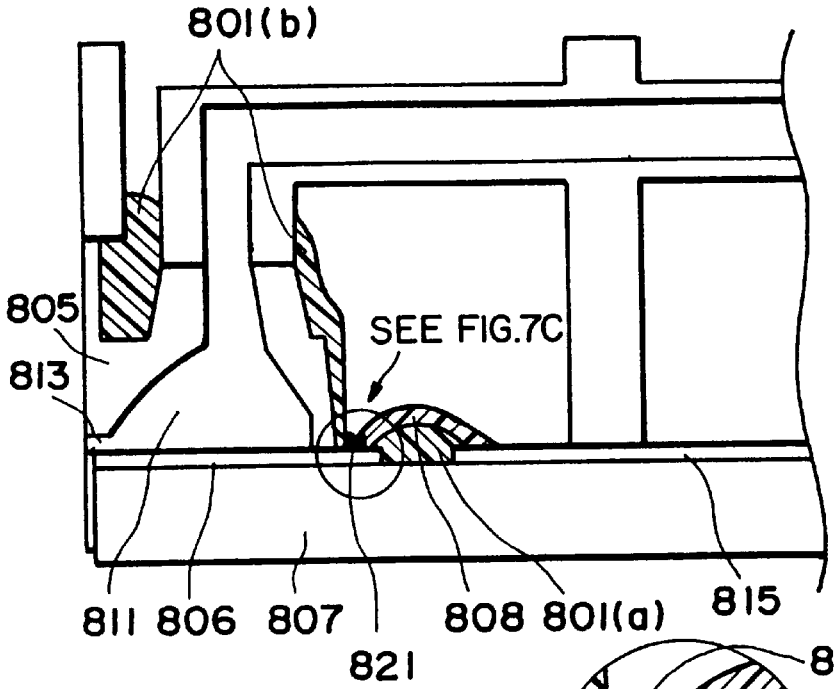
FIGS. 7A–D are schematic views of an ink jet recording head according to a second embodiment of the present invention.
Figure 7C:
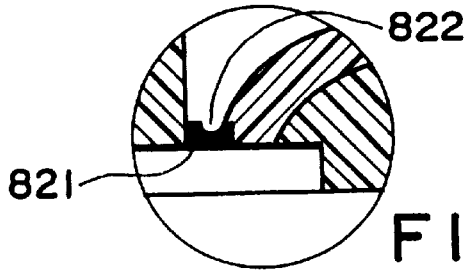

FIG. 7A is a sectional view of an ink jet recording head according to the second embodiment of the present invention.

Figure 7B:
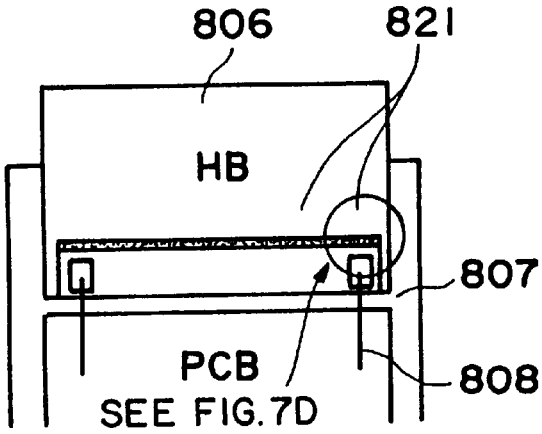
Figure 7D:
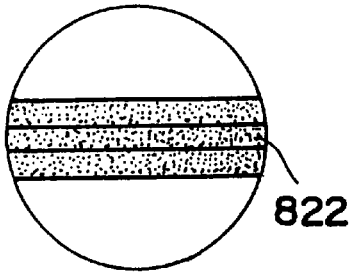

FIG. 7B is a top plan view.

Reference numerals 807, 806, 805 and 815 designate a base plate, heater board, a top plate with grooves and wiring board (PCV), respectively. By connecting the heater board 806 and the top plate 805 with each other, a liquid chamber 811 and liquid passages 813 are constituted. At the rear end of the heater board 806, there is provided electrode pads 816 for electric connection with the wiring board 815. The electrode pads of the heater board 806 and the wiring board 815 are connected by wire bonding 808. Designated by a reference numeral 821 is a projection formed between the wire bonding pad 816 and a portion of the heater board where the top plate is to be connected.

The top surface of the projection 821 is provided with a parallel groove 822 extending in a direction in which the energy generating elements are arranged. With this structure, the same effect as the plural projections are provided because of the existence of the groove, and the sealing material is effectively prevented from overflowing beyond the projection. Since the width of the projection is the same, the same contact area can be provided as in the case of single projection, and therefore, the removal of the projection from the base plate can be prevented.

Figure 8:
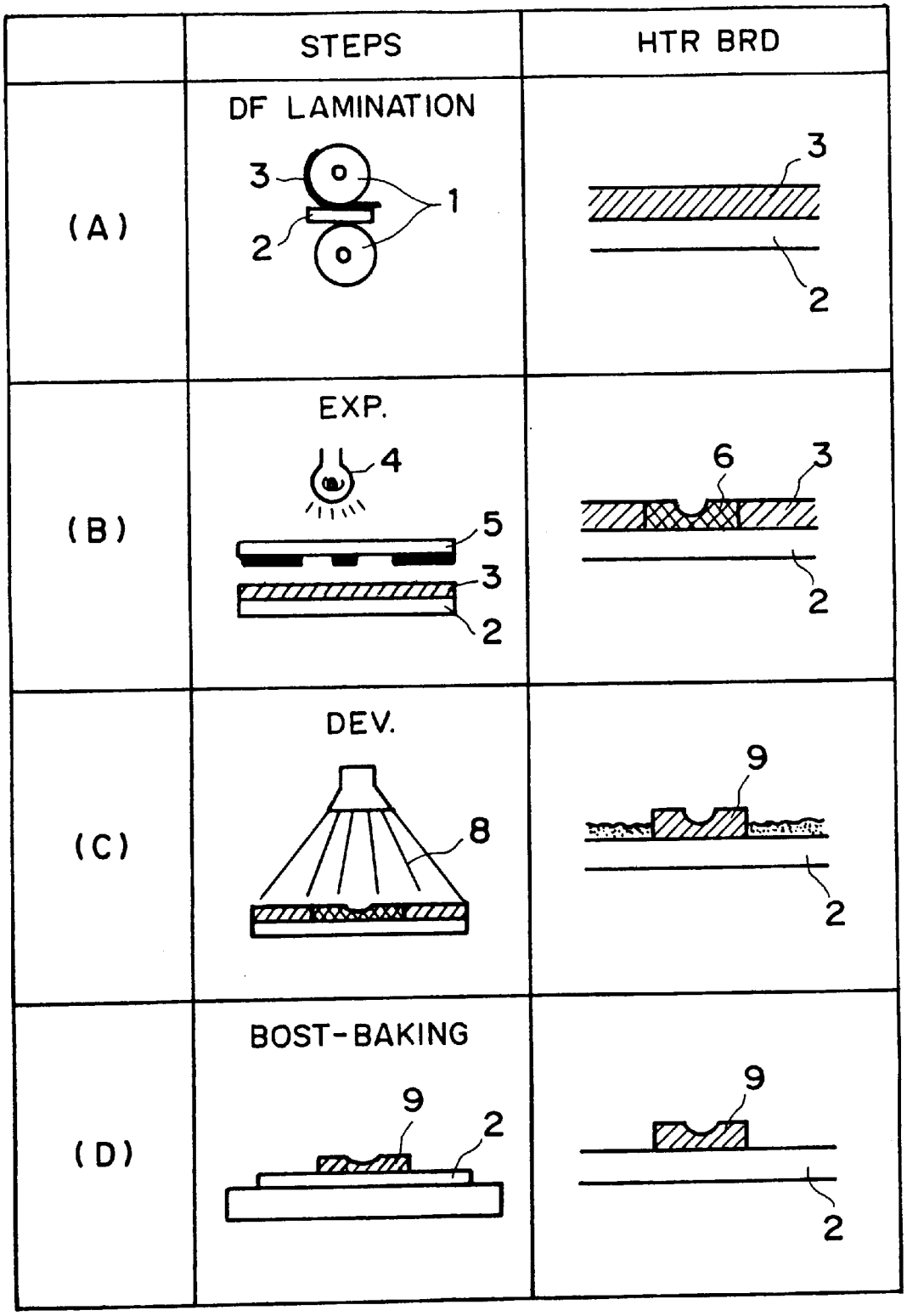
FIG. 8 illustrates a projection forming method according to a second embodiment of the present invention.

Referring to FIG. 8, the method of forming the projection will be described.

The silicone wafer 2 having the transducers is laminated with 40 $\mu$m of negative type dry film (DF) 3 ($\alpha$-540 by a laminator HRL-24 (available from Listen)), as shown in FIG. 8A. As shown in FIG. 8B, a photomask is used, and the exposure is carried out using parallel beam with exposure apparatus 4, PLA 600 (available from Canon Kabushiki Kaisha, Japan). As shown in FIG. 4C, shower development is effected using alkali solvent 8 containing 0.5% of TMAH (tetramethyl ammonium hydroxide, as shown in FIG. 8C). Then, post-baking is effected using hot plate for one minute at 120° C. and one minute as 180° C. By this, a projection 9 for preventing overflow of the sealing material is formed, as shown in FIG. 8D. Subsequently, the silicone wafer 2 is cut into individual heater boards. They are cleaned by high pressure cleaning with pure water at 70 kgf/cm$^2$ with the distance of 10 mm between the wafer and the cleaning nozzle.

Figure 9:
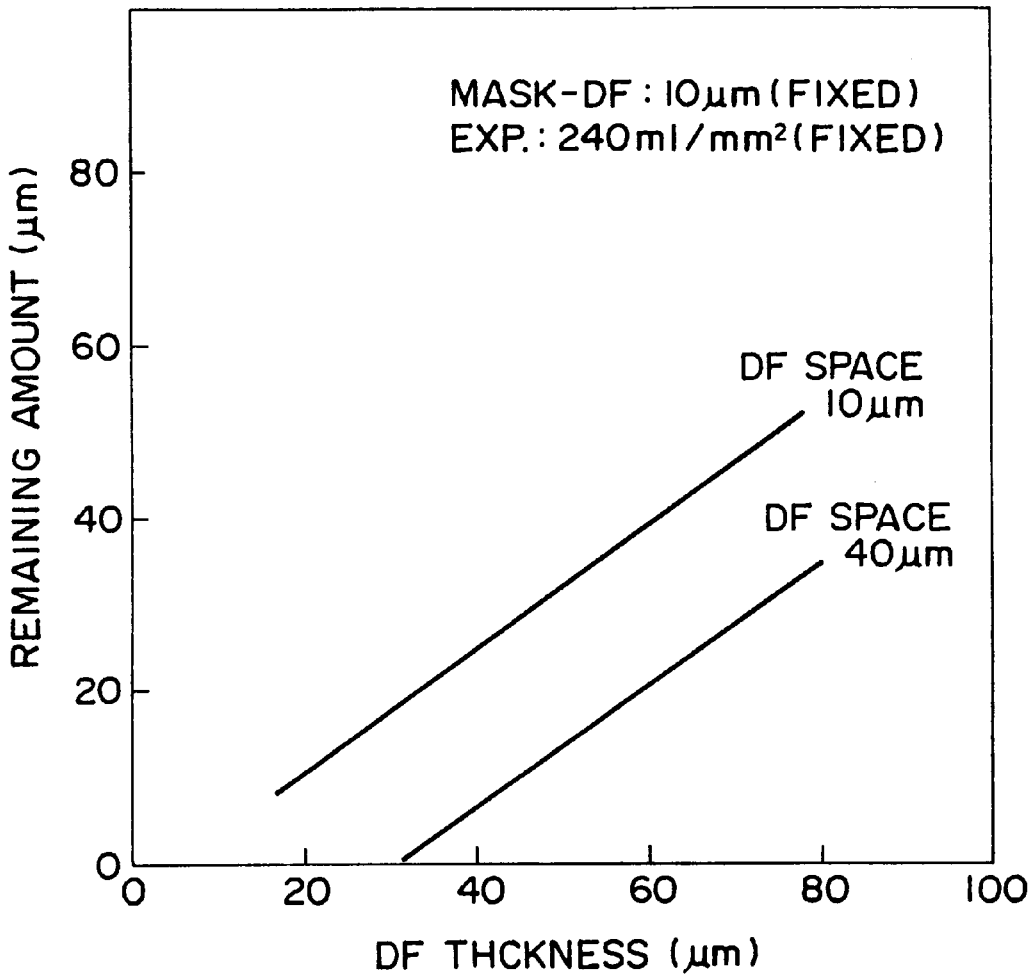
FIG. 9 illustrates a dry film thickness, and remaining amount between the dry films.

As for a method of forming the groove as shown in FIG. 8D, the diffraction of light from the mask is usable when the negative type photoresist is used as the material for the projection. When the exposure apparatus uses parallel light, this can be accomplished by properly changing the thickness of the dry film, the space between dry films, the amount of exposure and the distance between the mask surface and the dry film surface. As an example, as will be understood from FIG. 9, the remaining quantity (the remaining quantity of the dry film below the groove) increases with decrease of the space and the increase of the dry film thickness. This is because the quantity of the diffracted light increases with increase of the dry film thickness and decrease of the space.

When the exposure amount is increased, or when the distance between the dry film surface and the mask surface is increased, the same occurs, so that the configuration of FIG. 8D can be provided.

When the exposure apparatus is replaced with reflection type apparatus, the configuration of FIG. 8D, can be provided by deviating the focus position.

The description will be made as to the results of investigations of the strength, overflow prevention relative to the projection pattern and configurations as shown in FIG. 10 under the high pressure cleaning condition of 70 kgf/cm$^2$, and 10 mm between the wafer and the cleaning nozzle (conical type).

As will be understood from this Figure, the strength of the connection between the base plate and the projection is enough when one projection of 40 mm width without groove is used and when one projection having 40 $\mu$m width with one groove. However, one projection without groove is used, the sealing material overflows beyond the projection when the wire is sealed in some cases. This is because in the case of one projection without groove, the sealing member may overflow beyond the projection depending on the die bonding accuracy upon the bonding between the base plate and the heater board and on the accuracy of the dispenser for the sealing material. Using the projection with the top groove and using a plurality of projections, the sealing material does nut overflow beyond the projection. However, even if two projections are used, the strength thereof are not enough, and some are removed or dropped out, when the width of each of the projections is less than 30 $\mu$m.

As will be understood from the foregoing, the sealing material does not overflow over the projection if a groove is formed on the top surface of the projection, and if the width of the projection is 40 μm or larger, the projection is not removed.

FIG. 10 deals with the case of the thickness of 40 μm of the projection, but the same results are confirmed when the thickness of the projection is changed to 30, 50 and 75 μm.

Embodiment 3

In the first and second embodiments, the sealing material does not overflow beyond the projection, when a plurality of projections are used, each having the width not less than 40 μm. However, when the plurality of projections having the width not less than 40 μm, the space occupied by the projections is large, and therefore, with the small size substrate, the area is not usable. In this case, the particular problem is the strength of the projection (connection with the substrate). In the third embodiment, the surface of the substrate is provided with pits and projections to improve the connection. By doing so, the strength of the projection enough even if the width of the projection is not more than 40 μm.

Figure 11A:
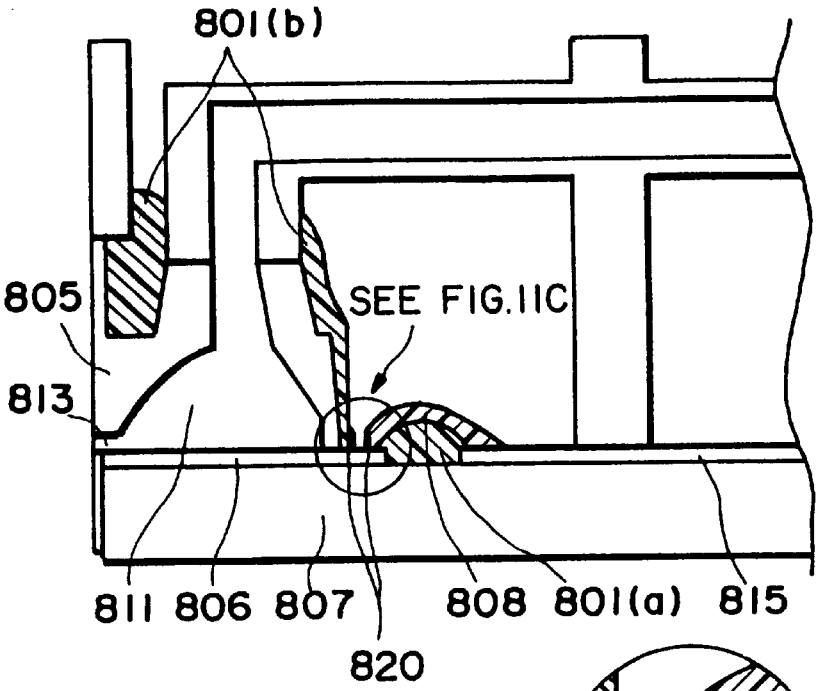
FIGS. 11A–D are schematic views of an ink jet recording head according to a third embodiment of the present invention.
Figure 11C:
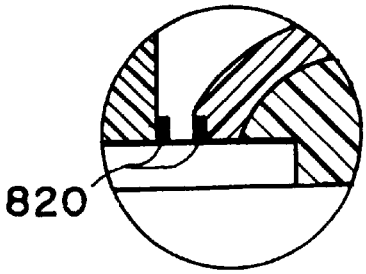
Figure 11B:
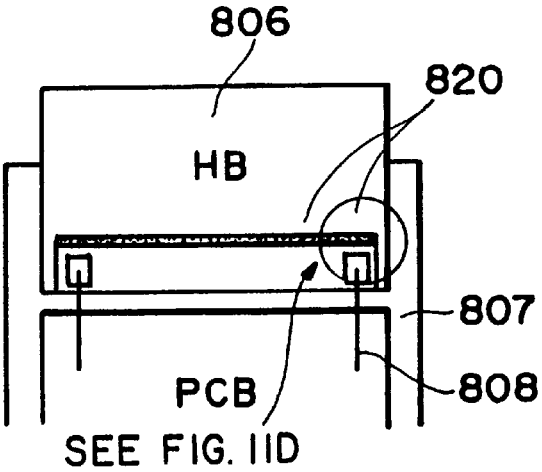
Figure 11D:
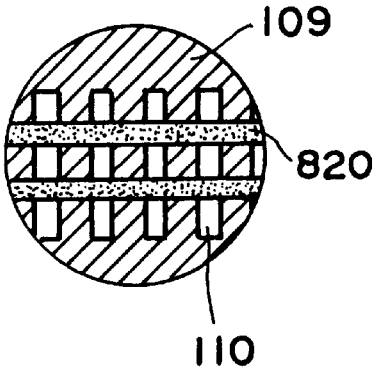

FIG. 11A is a sectional view of an ink jet recording head according to a third embodiment of the present invention, and FIG. 11B is a top plan view thereof.

Reference numerals 807, 806, 805 and 815 designate a base plate, heater board, a top plate with grooves aid wiring board (PCV), respectively. By connecting the heater board 806 and the top plate 805 with each other, a liquid chamber 811 and liquid passages 813 are constituted. At the rear end of the heater board 806, there is provided electrode pads 816 for electric connection with the wiring board 815. The electrode pads of the heater board 806 and the wiring board 815 are connected by wire bonding 808. Designated by a reference numeral 820 is a projection formed between the wire bonding pad 816 and a portion of the heater board where the top plate is to be connected.

Reference numerals 807, 806, 805 and 815 designate a base plate, heater board, a top plate with grooves and wiring board (PCV), respectively. By connecting the heater board 806 and the top plate 805 with each other, a liquid chamber 811 and liquid passages 813 are constituted. At the rear end of the heater board 806, there is provided electrode pads 816 for electric connection with the wiring board 815. The electrode pads of the heater board 806 and the wiring board 815 are connected by wire bonding 808. Designated by a reference numeral 820 is a projection formed between the wire bonding pad 816 and a portion of the heater board where the top plate is to be connected.

Below the projection 820, there are provided a plurality of pits and projections 110 without a protection layer, extending in a direction crossing with the projection 820. The projection or projections 820 are closely contacted on the protection layer of the substrate depending on the existence or non-existence of the pits and projections, and therefore, the strength of the projections 820 is increased, so that the removal thereof from the base plate can be prevented even if the width of the projection is 10 μm. The pits and projection pattern is formed by removing the protection layer, and therefore, the step between the pits and projection is approx. 3 μm at most, and therefore, the degree of step is not so large, and therefore, the overflow preventing performance is almost the same. The protection layer having the pits and projection pattern may be of metal film, organic material film, or inorganic insulative film.

The description will be made as to the results of investigations of the strength, overflow prevention relative to the projection pattern and configurations as shown in FIG. 10 under the high pressure cleaning condition of 70 kgf/cm$^2$, and 10 mm between the wafer and the cleaning nozzle (conical type).

As will be understood from this Figure, the projection is not removed from the substrate even if the width of the projection is 10 μm, when the pits and projection pattern is formed below the projection. Using this embodiment with the second embodiment (groove in the top surface), the projection forming area can be further reduced with maintaining the strength and the overflow preventing performance.

Figure 12:
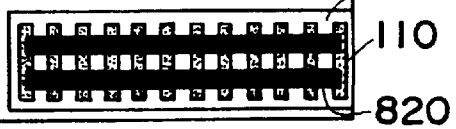
FIG. 12 illustrates contactness relative to a width of a projection and a configuration thereof and extension of the sealing material beyond the projection, in an ink jet recording head according to a third embodiment of the present invention.
Figure 13:
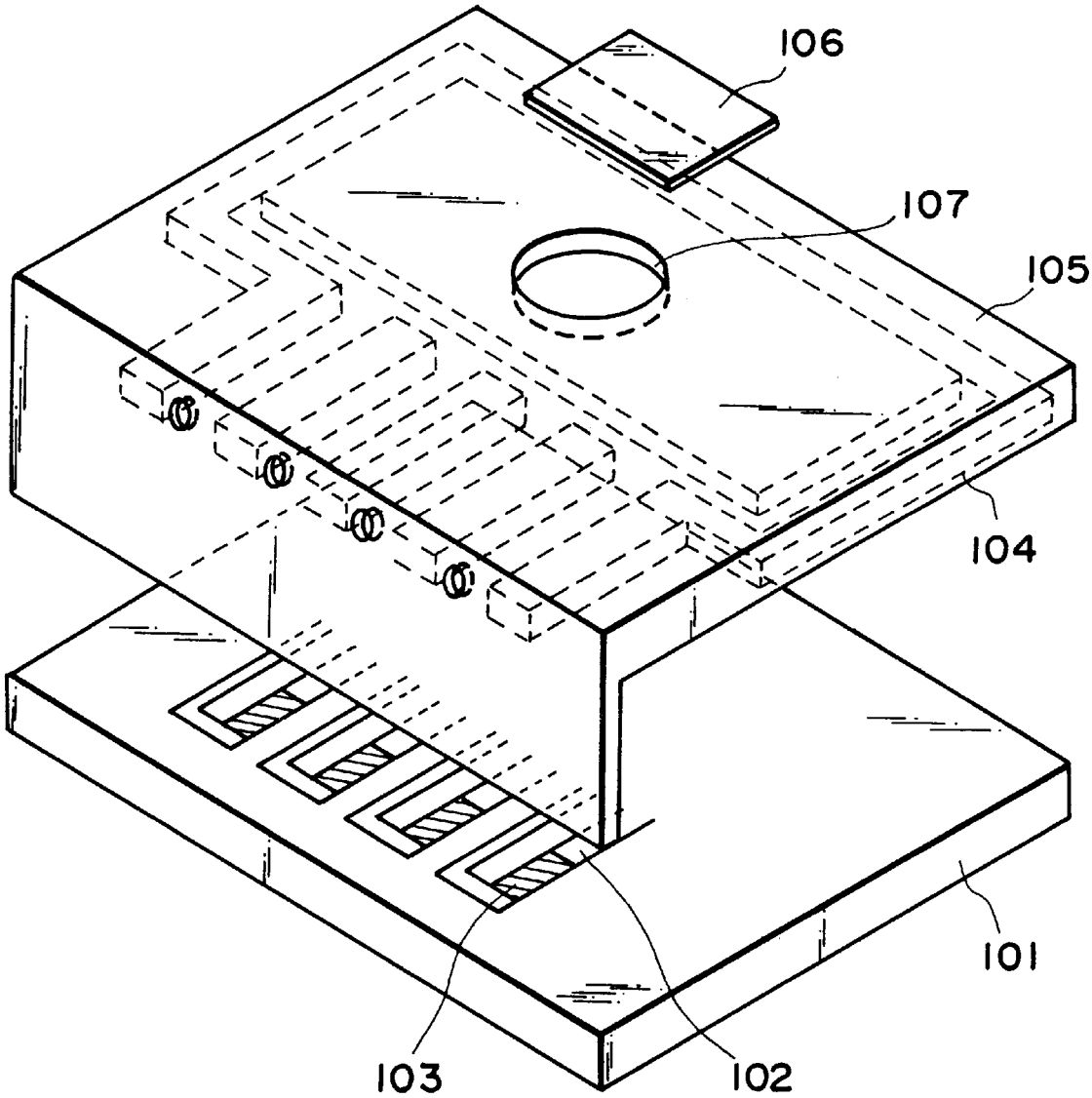
FIG. 13 illustrates an ejection element of an ink jet recording head.
Figure 14:
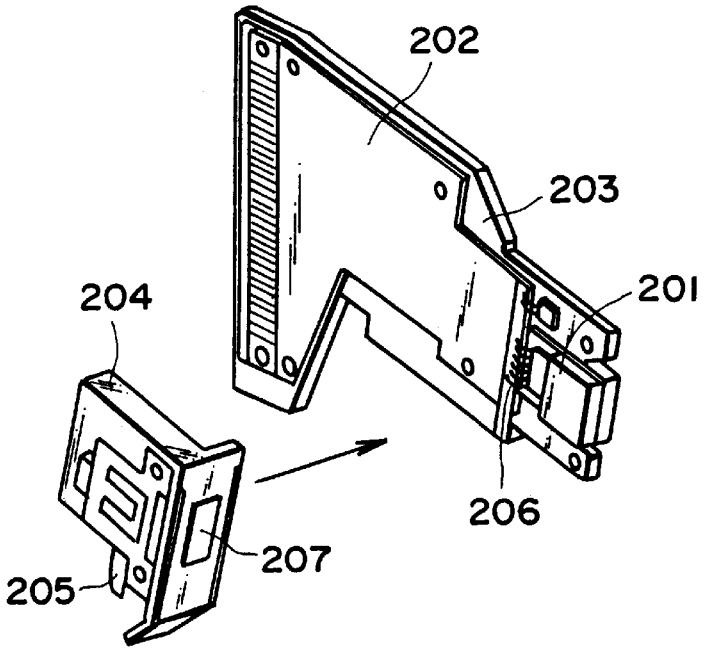
FIG. 14 illustrates an ink jet recording head.
Figure 15:
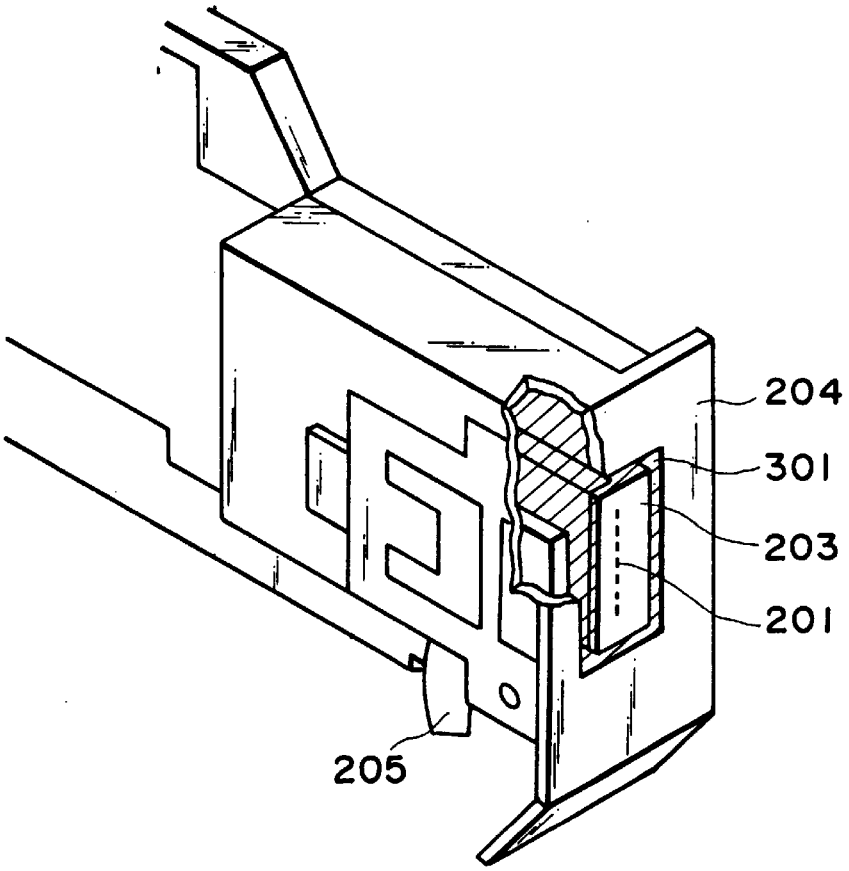
FIG. 15 is a partly enlarged view of an ink jet ejection outlet of an ink jet recording head.

In FIG. 12, the removal pattern width is 10 μm below the projection, and the interval is also projection. However, the pattern width may be 5 or 15 μm with the same advantageous effects. The bottom pattern may be of different configuration such rectangular or circular, with the same advantageous effects.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the healing surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single is color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink let recording apparatus may be used as an output terminal of an information processing apparatus such as computer or the like, as a copying apparatus combined with an image reader or the like, or as a facsimile machine having information sending and receiving functions.

Figure 16:
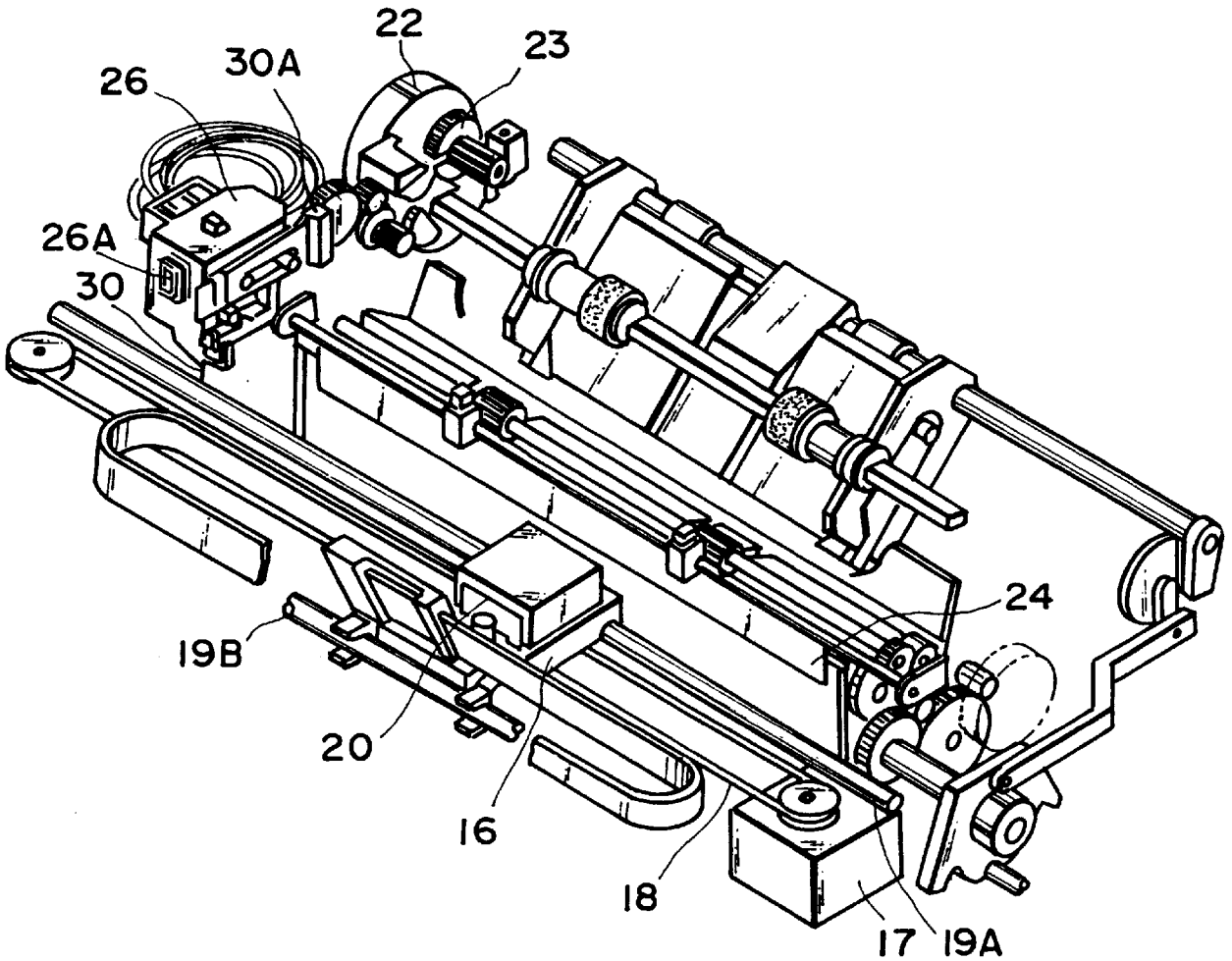
FIG. 16 is a perspective view of an ink jet recording apparatus having an ink jet recording head according to this invention as an ink jet cartridge.

FIG. 16 is shows an example of an ink jet recording apparatus (IJRA) containing a recording head according to the present invention as an ink jet head cartridge (IJC). In the Figure, an ink jet head cartridge 20 has a group of nozzles for ejecting the ink onto a recording surface of a recording material on a platen 24. A cartridge 16 supports the cartridge 20 and is connected with a driving belt 18 for transmitting the driving force from a driving motor 17. It is slidably supported on two parallel shafts 19A and 18B to scan over the entire width of the recording material.

A recovery mechanism 26 is disposed adjacent an end of a scanning path, for example, a home position. The cartridge 20 is capped by a motor 22 through a transmission mechanism 23. Upon completion of the recording operation, the capping is effected to protect the cartridge.

A blade 30 is disposed at a side of the recovery device 20, functions as a wiping member and is of silicone rubber. A black 31 is supported on a blade support 31A in the form of a cantilever, and is driven through a transmission mechanism 23 from motor 22, similarly to the head recovery device 26 to permit engagement with the ejection surface of the cartridge 20. Thus, at proper timing during the recording operation or after ejection recovery operation using the recovery device, the blade 31 enters the moving path of the cartridge 20 to remove dew and foreign matters from the ejection side surface of the cartridge 20 with movement of the cartridge 20.

While the invention has bean described with reference to the structures disclosed herein, it is not confined to the details set forth and this application is intended to cover such modifications or changes as may come within the purposes of the improvements or the scope of the following claims.

What is claimed is:

1. An ink jet recording head comprising:

a substrate having a plurality of ejection energy generating elements for ejecting ink;

a wiring board electrically connected at a first connecting region to an electric connection pad on said substrate and functioning to apply a voltage to said ejection energy generating elements;

a plate combined with said substrate, said plate being provided with a groove constituting an ink passage when the plate is combined with said substrate, there being a second connecting portion region between said substrate and said plate, said substrate having a projection at a position between said second connecting portion region and the pad, said first connecting portion region and said second connecting portion region each being sealed by a resin sealing material.

2. The ink jet recording head according to claim 1, wherein the projection comprises a photosensitive material which can be formed with an alkali developer liquid.

3. The ink jet recording head according to claim 2, wherein the projection is a dry-film.

4. The ink jet recording head according to claim 1, wherein the projection has a width of not less than 40 microns.

5. The ink let recording head according to claim 1, wherein a plurality of such projections are provided.

6. The ink jet recording head according to claim 1, wherein a top portion of the projection is provided with a groove extending parallel to a direction of an array of such ejection energy generating elements.

7. The ink jet recording head according to claim 6, wherein a plurality of such grooves are provided.

8. The ink jet recording head according to claim 1, wherein the projection is provided on a pits and projections pattern formed on said substrate.

9. The ink jet recording head according to claim 8, wherein the pits and projections pattern is provided by removing a protection layer.

10. The ink let recording head according to claim 9, wherein the pattern comprises pits arranged in a direction crossing with said projection.

11. An ink jet recording head comprising:

a substrate having a plurality of ejection energy generating elements for ejecting ink;

a wiring board electrically connected at a first connecting region to an electric connection pad on said substrate and functioning to apply a voltage to said ejection energy generating elements;

a plate combined with said substrate, said plate being provided with a groove constituting an ink passage when the plate is combined with said substrate, there being a second connecting region between said substrate and said plate, said substrate having a projection at a position between said second connecting region and the pad, said first connecting region is sealed by a first resin sealing material, and the second connecting region is sealed by a second resin sealing material;

wherein said projection between said second connecting portion and the pad provides a boundary between the first resin sealing material and the second resin sealing material.

12. The ink jet recording head according to claim 11, wherein the projection comprises a photosensitive material which can be formed with an alkali developer liquid.

13. The ink jet recording head according to claim 12, wherein the projection is a dry-film.

14. The ink jet recording head according to claim 11, wherein the projection has a width of not less than 40 microns.

15. The ink jet recording head according to claim 11, wherein a plurality of such projections are provided.

16. The ink jet recording head according to claim 11, wherein a top portion of the projection is provided with a groove extending parallel to a direction of an array of such ejection energy generating elements.

17. The ink jet recording head according to claim 16, wherein a plurality of such grooves are provided.

18. The ink jet recording head according to claim 11, wherein the projection is provided on a pits and projections pattern formed on said substrate.

19. The ink jet recording head according to claim 18, wherein the pits and projections pattern is provided by removing a protection layer.

20. The ink jet recording head according to claim 19, wherein the pattern comprises pits arranged in a direction crossing with said projection.

21. The ink jet recording head according to claim 11, wherein the first resin sealing material is a silicone sealing material.

22. The ink jet recording head according to claim 21, wherein the second resin sealing material is a silicone modified urethane sealing material.

23. The ink jet recording head according to claim 21, wherein the second resin sealing material seals a connecting portion for constitution of the passage and covers the first resin sealing material.

24. The ink jet recording head according to claim 11, wherein the first resin sealing material and the second resin sealing material are of silicone sealing material, and the second resin sealing material is coated with a silicone modified urethane sealing material.

25. A method of forming an ink jet recording head manufacturing method, comprising the steps of:

providing a substrate having a plurality of ejection energy generating elements for ejecting an ink and a projection; a wiring board electrically connected to an electric connection pad on said substrate and functioning to apply a voltage to said ejection energy generating element; a plate combined with said substrate, said plate being provided with a groove which defines an ink passage when the plate is combined with said substrate;

electrically connecting, using a first connecting portion, said substrate and said wiring board sealing said first connecting portion using a first sealing material; and connecting said substrate and said plate by sealing a second connecting portion between said substrate and said plate using a second sealing material, the projection of the substrate being disposed at a position between said second connecting portion and the pad, the connecting of the substrate and the plate taking place after the electric connecting between said substrate and said wiring board and the sealing of said first connecting portion are performed.

26. The method according to claim 25, wherein the projection comprises a photosensitive material which can be formed with an alkali developer liquid.

27. The method according to claim 26, wherein the projection is dry-film.

28. The method according to claim 26, wherein the projection is formed through photolithography.

29. The method according to claim 25, wherein the projection has a width of not less than 40 microns.

30. The method according to claim 25, wherein a plurality of such projections are provided.

31. The method according to claim 25, wherein a top portion of the projection is provided with a groove extending parallel to a direction of an array of such ejection energy generating elements.

32. The method according to claim 31, wherein a plurality of such grooves are provided.

33. A method according to claim 32, wherein the pits and projections pattern is provided by removing a protection layer.

34. The method according to claim 31, wherein the projection is of negative type photoresist material.

35. The method according to claim 34, wherein the projection is formed through photolithography.

36. A method according to claim 34, wherein the pattern comprises pits arranged in a direction crossing with the projection.

37. The method according to claim 25, wherein the projection is provided on a pits and projections pattern formed on the substrate.

38. A method according to claim 37, wherein the second resin sealing material is a silicone modified urethane sealing material.

39. A method according to claim 37, wherein the second resin sealing material seals a connecting portion for constitution of the passage and covers the first resin sealing material.

40. A method according to claim 25, wherein the first resin sealing material is a silicone sealing material.

41. A method according to claim 25, wherein the first resin sealing material and the second resin sealing material are of silicone sealing material, and the second resin sealing material is coated with a silicone modified urethane sealing material.

42. An ink jet recording head assembly comprising:

a substrate having a plurality of ejection energy generating elements for ejecting ink and a plate connecting portion for combining with a plate having a groove for constituting an ink passage;

a wiring board electrically connected by an electric connecting portion to an electric connection pad on said substrate and functioning to apply a voltage to said ejection energy generating elements and said electric connecting portion being sealed by a resin sealing material;

wherein said substrate has a projection at a position between said plate connecting portion and the pad, so that said projection serves as a dam blocking said resin sealing material.

* * * * *

UNITED STATES PATENT AND TRADEMARK OFFICE

CERTIFICATE OF CORRECTION

PATENT NO. : 5,963,232
DATED : October 5, 1999
INVENTOR(S) : Masami Kasamoto et al.

It is certified that error appears in the above-identified patent and that said Letters Patent is hereby corrected as shown below:

Title page,
Item [57], Abstract,
Line 3, "region" should read -- portion --;
Line 8, "region" should read -- portion --;
Line 11, "region" (both occurrences) should read -- portion --;
Line 12, "region" should read -- portion --.

Drawings,
Sheet 4, FIG. 5, " SLASS" should read -- GLASS --;
Sheet 5, FIG. 6, "HIGHT" should read -- HEIGHT --;
Sheet 8, FIG. 9, "THCKNESS" should read -- THICKNESS --;
Sheet 9, FIG. 10B, "CONACTNESS" should read -- CONTACTNESS --; and
Sheet 11, FIG. 12, "CONACTNESS" should read -- CONTACTNESS --.

Column 1,
Line 16, "and is" should read -- and --;
Line 27, "election" should read -- ejection --;
Line 31, "is, disposed" should read -- is disposed --;
Line 46, "passage" should read -- passages --;
Line 47, "And" should read -- and --; and
Line 52, "portion" should read -- portions --.

Column 2,
Line 25, "atter" should read -- after --; and
Line 63, "In" should read -- in --.

Column 3,
Line 16, "said substantial" should read -- said substrate --;
Line 35, "provided" should read -- provide --; and
Line 41, "electrically," should read -- electrically --.

Column 5,
Line 12, "Kasai" should read -- Kasei --;
Line 25, "scaling" should read -- sealing --;
Line 27, "satisfy" should read -- to satisfy --;
Line 29, "satisfy" should read -- to satisfy --
Line 35, "exhibit" should read -- exhibits --;
Line 42, "scals" should read -- seals --; and
Line 48, "is separated" should read -- are separated --.

UNITED STATES PATENT AND TRADEMARK OFFICE

CERTIFICATE OF CORRECTION

PATENT NO. : 5,963, 232
DATED : October 5, 1999
INVENTOR(S) : Masami Kasamoto et al.

It is certified that error appears in the above-identified patent and that said Letters Patent is hereby corrected as shown below:

Column 6,
Line 18, "as 180° C." should read -- at 180 C. --.

Column 7,
Line 40, "projection" should read -- projections --.

Column 8,
Line 15, "as 180° C." should read -- at 180° C. --;
Line 62, "does nut" should read -- does not --; and
Line 63, "strength" should read -- strengths --.

Column 9,
Line 20, "enough" should read -- is enough --; and
Line 26, "aid" should read -- and --.

Column 10,
Line 17, "such" should read -- such as --; and
Line 41, "the the" should read -- the --.

Column 11,
Line 24, "is" should be deleted;
Line 41, "is the" should read -- in the --;
Line 60, "ink let" should read -- ink jet --; and
Line 66, "is" should be deleted.

Column 12,
Line 26, "bean" should read -- been --;
Line 35, "at a first" should read -- by a first --;
Line 36, "region" should read -- portion --;
Line 42, "the plate is" should read -- it is --;
Line 43, "region" should be deleted;
Line 46, "region" should be deleted;
Line 47, "region" (both occurrences) should be deleted;
Line 49, "The ink" should read -- An ink --;
Line 52, "The ink" should read -- An ink --;
Line 54, "The ink" should read -- An ink --;
Line 57, "The ink" should read -- An ink --;

UNITED STATES PATENT AND TRADEMARK OFFICE

CERTIFICATE OF CORRECTION

PATENT NO. : 5,963, 232
DATED : October 5, 1999
INVENTOR(S) : Masami Kasamoto et al.

It is certified that error appears in the above-identified patent and that said Letters Patent is hereby corrected as shown below:

Column 12 (cont.),
Line 59, "The ink" should read -- An ink --;
Line 63, "The ink" should read -- An ink --; and
Line 65, "The ink" should read -- An ink --.

Column 13,
Line 1, "The ink" should read -- An ink --;
Line 4, "The ink" should read -- An ink --; and "let" should read -- jet --;
Line 10, "region" should read -- portion--;
Line 15, "the plate is" should read -- it is --;
Line 16, "region" should read -- portion--;
Line 18, "region" should read -- portion--;
Line 19, "region" should read -- portion--;
Line 21, "region" should read -- portion--;
Line 26, "The ink" should read -- An ink --;
Line 29, "The ink" should read -- An ink --;
Line 31, "The ink" should read -- An ink --;
Line 34, "The ink" should read -- An ink --;
Line 36, "The ink" should read -- An ink --;
Line 40, "The ink" should read -- An ink --;
Line 42, "The ink" should read -- An ink --;
Line 45, "The ink" should read -- An ink --;
Line 48, "The ink" should read -- An ink --;
Line 51, "The ink" should read -- An ink --;
Line 54, "The ink" should read -- An ink --;
Line 57, "The ink" should read -- An ink --;
Line 61, "The ink" should read -- An ink --;
Line 66, "A method of forming an" should read -- An --.

Column 14,
Line 11, "board" should read -- board; --;
Line 24, "The method" should read -- A method --;
Line 27, "The method" should read -- A method --;
Line 29, "The method" should read -- A method --;
Line 31, "The method" should read -- A method --;
Line 33, "The method" should read -- A method --;
Line 35, "The method" should read -- A method --;

UNITED STATES PATENT AND TRADEMARK OFFICE

CERTIFICATE OF CORRECTION

PATENT NO. : 5,963, 232
DATED : October 5, 1999
INVENTOR(S) : Masami Kasamoto et al.

It is certified that error appears in the above-identified patent and that said Letters Patent is hereby corrected as shown below:

Column 14 (cont.),
Line 39, "The method" should read -- A method --;
Line 44, "The method" should read -- A method --;
Line 46, "The method" should read -- A method --;
Line 51, "The method" should read -- A method --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*